US008847772B2

(12) United States Patent
Marks et al.

(10) Patent No.: US 8,847,772 B2
(45) Date of Patent: Sep. 30, 2014

(54) SMOKE DETECTOR WITH REMOTE ALARM SILENCING MEANS

(76) Inventors: Mitchell J. Marks, Brown Deer, WI (US); James N. Richey, Franklin, WI (US)

( * ) Notice: Subject to any disclaimer, the term of this patent is extended or adjusted under 35 U.S.C. 154(b) by 1065 days.

(21) Appl. No.: 11/548,462

(22) Filed: Oct. 11, 2006

(65) Prior Publication Data

US 2007/0080819 A1 Apr. 12, 2007

Related U.S. Application Data

(60) Provisional application No. 60/726,051, filed on Oct. 12, 2005.

(51) Int. Cl.
*G08B 17/10* (2006.01)
*G08B 29/14* (2006.01)

(52) U.S. Cl.
CPC ..... *G08B 17/10* (2013.01); *G08B 29/145* (2013.01)
USPC ..... 340/628; 340/693.3

(58) Field of Classification Search
USPC ..... 340/628, 506, 693.3
See application file for complete search history.

(56) References Cited

U.S. PATENT DOCUMENTS

| | | | | |
|---|---|---|---|---|
| 4,357,602 | A * | 11/1982 | Lemelson | 340/539.27 |
| 4,750,118 | A * | 6/1988 | Heitschel et al. | 700/90 |
| 5,905,438 | A * | 5/1999 | Weiss et al. | 340/636.1 |
| 5,907,279 | A * | 5/1999 | Bruins et al. | 340/506 |
| 6,624,750 | B1 * | 9/2003 | Marman et al. | 340/506 |
| 6,753,786 | B1 * | 6/2004 | Apperson et al. | 340/628 |
| 6,762,688 | B2 * | 7/2004 | Johnston et al. | 340/628 |
| 6,975,223 | B1 * | 12/2005 | Mladen et al. | 340/539.14 |
| 2001/0006366 | A1 * | 7/2001 | Curran et al. | 340/518 |
| 2001/0038337 | A1 * | 11/2001 | Wickstead et al. | 340/628 |
| 2002/0126016 | A1 * | 9/2002 | Sipp | 340/628 |
| 2006/0164253 | A1 * | 7/2006 | Harvey et al. | 340/628 |

* cited by examiner

*Primary Examiner* — Mohammad Ghayour
*Assistant Examiner* — Brian Wilson

(57) ABSTRACT

A smoke detector employs a receiver and a remote transmitter to silence the audible alarm of the smoke detector in the event the detector was triggered by nuisance smoke. The receiver and transmitter circuits are designed to operate in a no-power or low-power consumption mode until the alarm is activated or the remote transmitter is actuated.

5 Claims, 3 Drawing Sheets

SMOKE DETECTOR WITH REMOTE ALARM SILENCING MEANS

This application claims the benefit and priority of U.S. Provisional Pat. App. No. 60/726,051 filed Oct. 12, 2005.

FIELD OF THE INVENTION

This invention relates generally to devices that are used in homes for the detection of smoke, such devices emitting an audio alarm signal of some sort to alert the occupants of a home that smoke, and perhaps a fire that is the source of the smoke, has been detected by the device. More particularly, this invention relates to a smoke detector that includes a wireless remote alarm silencing means such that the user, knowing that the source of the smoke is harmless or is under control, may remotely silence the alarm of the smoke detector for a pre-programmed or a pre-programmable period of time. It also relates to such a smoke detector where the silencing means is removably locatable with minimal effort by the user and is preferably an easily replaceable item.

BACKGROUND OF THE INVENTION

Smoke detectors are well known in the art. Smoke detectors have been used for years to prevent damage, destruction, and even death that can result from an undetected fire that has started somewhere within the living quarters of a home or within other structures that are occupied by persons from time to time. Smoke detectors, when properly used and maintained, have been credited for saving many lives over the years.

Smoke detectors are typically mounted to the ceilings of structures or at high points along vertical walls, it being known that fires generally burn upwardly and that smoke from fires generally rises. The typical smoke detector can be "hard-wired" into the circuitry of the home or can be used with a small battery, or even a combination of the two for purposes of "back-up." The internal circuitry of the typical smoke detector is relatively simple. The power supply is usually connected in series with an alarm device, such as an audio speaker, and with a smoke sensor or detection device. As long as the smoke sensor or detection device does not detect any smoke, the circuit remains open. If smoke is detected, the circuit becomes closed, thereby activating the audio alarm by allowing current to pass through it. The means for smoke detection is typically provided by two immediately-adjacent, but slightly separated, parallel detection plates contained within the smoke sensor or detection device. When smoke particles find their way between the two detection plates, and are in sufficient density or quantity to "trigger" the sensor, the circuit then closes, and the circuit allows the audio alarm to have current provided to it and allows it to "sound off." Other variations of this basic circuitry exist, but most smoke detectors operate in essentially the same fashion.

One inconvenience that is often experienced in the use of such smoke detectors of current manufacture is the fact that the occupant of a home in which such detectors are used can create a "controlled" situation where "nuisance" smoke is emitted and the smoke detector becomes activated, thus sounding the audio alarm. While this is not a "false reading" type of a situation, since the smoke detector is reacting to a condition that it was designed to detect, it is a situation where the occupant is in full control of the situation. The occupant may be cooking in the kitchen, for example, where an excess deposit of material may have momentarily ignited in the oven, and the smoke detector sounds off. In this type of a situation, it would be desirable if the occupant could momentarily silence the audio alarm component of the smoke detector to avoid the annoying alarm that is sounded without completely disarming or deactivating the smoke detector.

One way of temporarily "silencing" the smoke detector alarm is to simply stand under it and wave a towel around it to dissipate the accumulated nuisance smoke. What this is really doing is diminishing the amount of smoke that is sensed by the detector which, in turn, temporarily "silences" the alarm. However, the nuisance smoke usually re-activates the smoke detector, thereby requiring the user to repeat this futile activity. Another way of completely disarming or deactivating the smoke detector altogether is for the user to place a chair under it, climb up onto the chair, and reach up and pull the battery out of the smoke detector, the battery being plugged into a pair of terminals that are intended to retain the battery within the unit. In the experience of these inventors, the battery is easily detachable by simply accessing a battery compartment that is enclosed by an equally easily removable cover. Unfortunately, this method requires that the battery be replaced at a later time anyway. If forgotten, a hazardous, or even deadly, condition could exist. And if the smoke detector is hard-wired into the circuitry of the home, this method won't work anyway.

Other assemblies of prior art have also attempted to provide the user of a smoke detector with the ability to totally or partially deactivate a smoke detector during the situation described above. One such device provides the smoke detector with a button located on the smoke detector housing that can be pushed to deactivate the unit. That is, many newer smoke detectors now have a "mute" or "silence" button on the smoke detector itself. This button is intended to allow the user to silence the audible alarm for a period of time if the alarm was caused by nuisance smoke. This method still requires the user to climb up onto something in order to reach the smoke detector deactivation button. Another such device provides a hard wired, remote switch that can be located in a specific location, perhaps in the vicinity of a problem-some appliance, such as a stove or oven. This requires the installation of a switch in a specific location and provides for no variability in the location of the switch, at least not easily. Movement or relocation of appliances may work to make the switch impractical to use or even completely inaccessible. Still another assembly of prior art utilizes a remote switch that, though not hard wired, is intended to be fully remote and portable within the home. The remote switch of this type, much like the proverbial television remote control, is not attachable to a vertical surface, such as a wall, and is prone to being lost or misplaced.

Another concern with smoke detectors of current manufacture is meeting battery life requirements set forth by law. However, requiring a radio frequency (RF) receiver to continuously "listen" for incoming RF messages greatly increases power consumption and requires a much larger battery than is typically used in a smoke detector.

In the view of these inventors, what is needed is a smoke detector with a remote wireless alarm silencing means wherein the remote means is not hard-wired to the smoke detector but which allows the remote means to be mountable yet easily relocatable throughout the normal area of its use. That is, the means, or several of them, could be used by the user to remotely silence the smoke detector alarm for a short pre-programmed period of time, the remote silencing means being easily mountable to a smooth, flat surface, but also being easily relocatable as desired or required.

What is also needed is a remote alarm silencing means that is capable of muting the alarm, reducing its volume and/or lighting a light to indicate actuation of the silencing means. The smoke detector should also be capable of remotely actuating a "test" light to ensure that the detector is operable.

What is also needed is a remote alarm silencing means that is simple in construction and is an easily replaceable item. However, the remote alarm silencing means should include a long-life, self-contained power source within it and also include means for placing the remote alarm silencing means in a "no-power" or "low-power" consumption mode.

In order to accomplish its function, the transmitting frequency of the remote alarm silencing device must match the receiving frequency of an electronically-activated switching or pulse-generating circuit within the smoke detector itself. It would also be desirable that the smoke detector include a "code learning" feature to accomplish this matching. In this way, off-the-shelf silencing devices may be purchased to replace existing devices that come with the primary detector unit at the time of original purchase. What is also needed is a primary detector unit that includes a battery-access port having a screw within it for preventing the easy removal of the battery from the smoke detector, or at least making it less convenient to remove the battery than in a unit where the battery-access port does not include the screw.

In the experience of these inventors, most smoke detectors are contained within an off-white or white exterior housing. Accordingly, what is also needed is such a smoke detector having a remote alarm silencing means that is also aesthetically-pleasing to the user, the remote alarm silencing means including a simple button-switch mounted or encapsulated within a housing that may be purchased by the user in a personally-pleasing decorated fashion, much as cell phones and other devices have interchangeable housings that come in a wide variety of colors, patterns and designs. In this way, the remote alarm silencing unit of the present invention would be somewhat of a décor-complementing device.

SUMMARY OF THE INVENTION

It is, therefore, a principal object of this invention to provide a new, useful, and uncomplicated smoke detector having a remote alarm silencing means in the form of a mountable remote control device but wherein the remote control device is not hand-held or hard-wired to the smoke detector and which emits electromagnetic waves of a given frequency to temporarily mute or silence the audio alarm of the smoke detector and which also allows remote testing of the detector. The remote control device is mountable yet easily relocatable as desired or required by the user. In this way, the silencing means remains in a given location or position where the user will be able to easily locate it and thus easily silence the alarm of the smoke detector. It is another object of the present invention that the remote control device of the present invention, or several of them, be used by the user to remotely silence the alarm of the smoke detector for a short pre-programmed period of time. The smoke detector could be alternatively configured to silence the alarm, reduce the volume of the alarm, and/or activate a visual indicator, such as a light, to indicate that the silencing means has been activated. It is still another object of the present invention to provide a smoke detector having a remote control device that is re-locatable with minimal effort throughout a variety of places within the home. It is still another object to provide a remote silencing device that can come as original equipment with a smoke detector or that can be separately purchased as a replacement unit, the electromagnetic frequency of the replacement unit matching that of the original remote silencing means. The remote control and the smoke detector would allow for "code learning" which allows for selective alarm actuation. It is yet another object of the present invention to provide a remote control device that has its own self-contained long-life battery for allowing the device to generate and transmit an electromagnetic wave, such as an RF signal, of sufficient energy to be detected by a receiver component within the smoke detector unit, the receiver component silencing the alarm of the smoke detector unit. It is still another object of the present invention to provide a remote control device that is to be used with the smoke detector of the present invention that is aesthetically-pleasing to the user and that may be purchased by the user in a personally-pleasing decorated fashion offered in a wide variety of shapes, colors, patterns and designs or that may be offered with interchangeable housings that come in a wide variety of shapes, colors, patterns and designs.

The present invention has obtained these objects. It provides for a smoke detector having a remote alarm silencing means wherein the remote means that is used is not hard-wired to the smoke detector and which allows the remote means to be mountable yet easily relocatable as desired or required. That is, the means, or several of them, can be used by the user to remotely silence the alarm of the smoke detector for a short pre-programmed period of time, the remote silencing means being generally re-locatable throughout a variety of places within the area and vicinity of the primary smoke detector unit. The remote alarm silencing means can also be configured to mute or silence the alarm, reduce its decibel level, and/or activate a visual indicator. The visual indicator could also be used as a means for remote testing of the operability of the smoke detector.

The remote alarm silencing means is constructed in the form of a remote control device that is powered by a long-life battery and is capable of generating and transmitting a wireless electromagnetic wave signal that can be detected by a receiver component in the smoke detector.

The present invention is drawn, in its preferred embodiment, to a smoke detector that employs an RF receiver in conjunction with a remote RF transmitter to silence the audible alarm in the event the detector was triggered by nuisance smoke. The smoke detector is mounted to the ceiling in similar fashion as standard smoke detectors. The remote RF transmitter, however, can be mounted in any convenient location within easy reach of the occupant or user. When the smoke detector sounds an audible alarm due to nuisance smoke, the user can quickly and conveniently press the button on the remote transmitter to silence the audible alarm of the smoke detector for a period of time.

Additionally, the RF transmitter of the present invention can be programmed with a unique "transmitter identification" or "ID" at the time of manufacture. This unique ID or identification would then be transmitted with each RF message to uniquely identify itself from other RF transmitters. At some time in the manufacturing process, the smoke detector and the remote RF transmitter can be paired in a fashion where the detector "learns" the unique ID of the transmitter and thereby will only silence the audible alarm if it receives an RF message from that particular transmitter. This is critical when several smoke detectors are installed in a building since a particular remote RF transmitter should only silence the audible alarm on the smoke detector it was intended to silence, not all of the detectors in the building or surrounding area. This unique ID also allows multiple RF transmitters to operate on the same RF frequency, thus greatly simplifying the manufacturing process.

To eliminate increased power consumption due to the RF receiver being required to "listen" for incoming RF messages, the present invention also implements means to activate the RF receiver only when the audible alarm has been activated. Once the audible alarm has been silenced or deactivated by the detector, the RF receiver would also be deactivated or put into a "sleep" mode. This approach absolutely minimizes energy consumption of the battery without compromising the "silence" feature of the present invention. As an example, if the RF receiver was allowed to operate continuously, it could very well receive an RF message from an RF transmitter with an ID that matched the ID stored within the detector. If this RF message was received when no audible alarm was active, the detector would not perform any function after receipt of the RF message (i.e., there is no alarm to silence). So there is no need to listen for RF messages unless the audible alarm is active anyway. In this regard, the smoke detector of the present invention allows the RF receiver to continuously "listen" for incoming RF messages only upon the occurrence of an alarm status within the smoke detector.

The remote alarm silencing means includes an adhesive backing that allows the remote control device to be secured to any smooth flat surface. The remote alarm silencing means is also re-locatable by virtue of this adhesive backing and is also replaceable by an after-purchase unit having the same transmitting frequency as the original remote control silencing means. The remote alarm silencing means is simple in design and includes a housing having a button-switch disposed or encapsulated within it, whereby pressing of the button silences the alarm of the smoke detector for a pre-programmed period of time. It does not, however, completely deactivate the smoke detector or the smoke-detection circuitry. The remote alarm silencing means that is used with the smoke detector of the present invention is also aesthetically-pleasing to the user, the remote alarm silencing means preferably including a remote-control button-switch that can be purchased by the user in personally-pleasing decorated fashion, much as cell phones and other devices have interchangeable housings that come in a wide variety of colors, patterns and designs. Preferably, the remote control unit is round or oval-shaped in physical design and includes a large, centrally-disposed button-switch within it, but is not limited to that shape. In the smoke detector unit of the present invention that uses the remote silencing means as disclosed, the detector unit includes a battery port or compartment having a cover that is secured with a screw to deter the user from conveniently deactivating the entire smoke detection unit by removing the battery from the unit.

The foregoing and other features of the smoke detector with remote alarm silencing means that is constructed in accordance with this invention will be apparent from the detailed description that follows.

DETAILED DESCRIPTION

Figure 1:
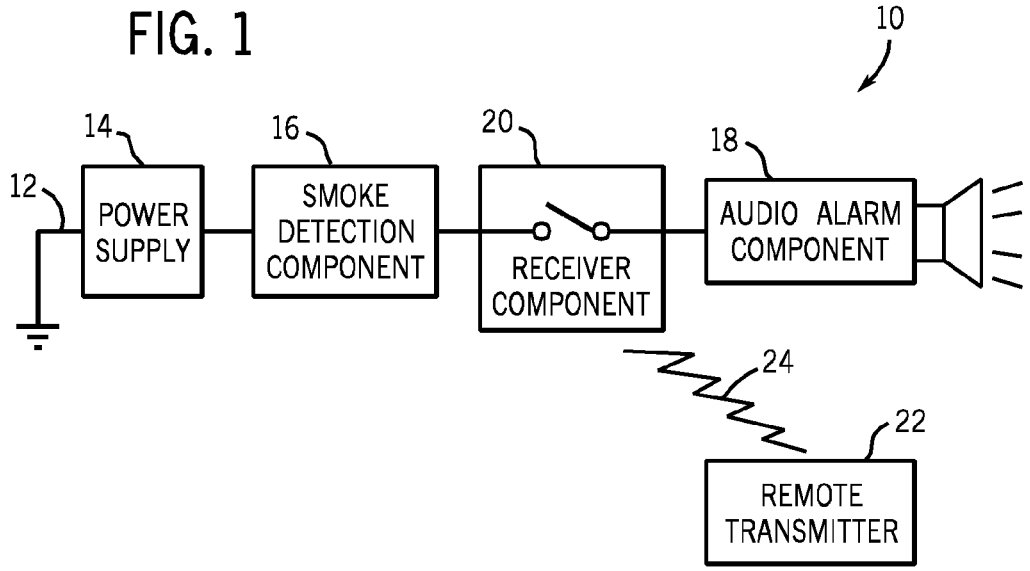
FIG. 1 is a simplified schematic diagram of the circuitry components of a smoke detector with remote alarm silencing means that is constructed in accordance with the present invention.

Referring now to the drawings in detail, wherein like numbered elements refer to like elements throughout, FIG. 1 illustrates a simplified schematic diagram of a first preferred embodiment of the circuit, generally identified 10, that is used in the smoke detector of the present invention. The circuit 10 includes a power supply 14, a smoke detection component 16, an audio alarm component 18, and a receiver component 20. These components are electrically connected 12. The circuit 10 also includes a component that is not electrically connected to the other components in the usual sense. More specifically, the circuit 10 includes a remote wireless transmitter 22 that emits and transmits electromagnetic waves 24 to actuate the receiver component 20 of the circuit 10. The remote transmitter 22 operates on conventional direct current batteries of the type that are compact and commercially available today. The precise voltage is not a limitation of the present invention. The preferred embodiment of the invention, however, utilizes a long-life, self-contained lithium battery having a life of about five years such that the remote transmitter 22 is more or less a "throw-away" or disposable item. That does not mean, however, that the transmitter 22 should ever be thrown away without being immediately replaced by a like unit, for obvious safety reasons.

In the preferred embodiment of the smoke detector of the present invention, the smoke detection component 16 is in the "normally open" electrical state. That is, it appears as an open non-current conducting circuit element during normal operation. The receiver component 20 is in a "normally closed" electrical state which means that it appears as a current conducting circuit element. That is, during normal operation of the circuit 10, the receiver component 20 remains in an electrically-conductive state unless and until its internal switch (not shown) is opened. It will become apparent later in this detailed description that maintaining the receiver component 20 in this state may not, however, be advantageous for purposes of maximizing battery life. If the smoke detection component 16 becomes "activated" by the presence of smoke particles in the vicinity of the circuit 10, that component 16 becomes closed, or otherwise closes the series circuit to the remaining circuit elements, and the audio alarm component 18 becomes actuated to sound its audio alarm.

During the sounding of the audio alarm component 18 in the preferred embodiment of the present invention, the internal switch of the receiver component 20, which is in its normal condition "closed," can be "opened" by the receiver component's 20 response to its receipt of an electromagnetic wave 24 that is emitted at a given frequency from the remote transmitter 22 upon actuation of the transmitter 22. That is, by pushing the button of the remote transmitter 22, the audio alarm component 18 is "silenced" because its electrical current supply from the power supply 14 is interrupted. The receiver component 20 includes an electrical pulse switch that effectively "mutes" or silences the alarm 18 for a pre-programmed period of time. The circuitry of the pulse switch could be variable in design and the present invention is not limited to the precise form of circuitry required to achieve this functionality.

Figure 2:
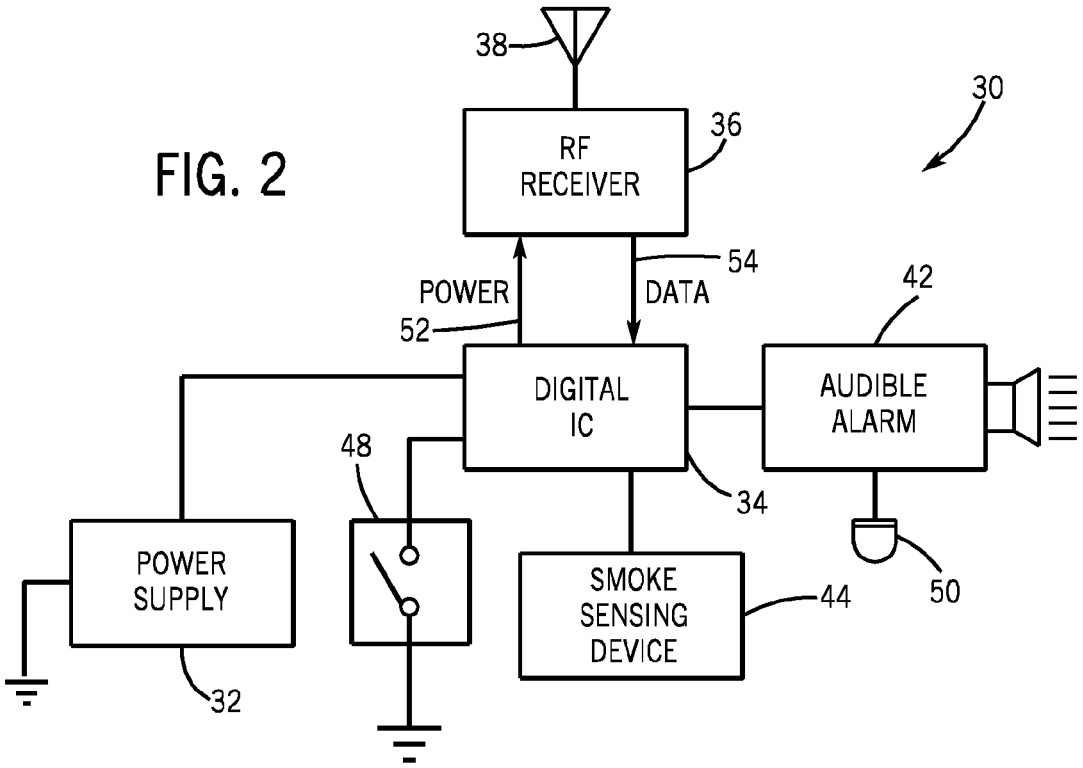
FIG. 2 is a simplified schematic diagram of an RF receiver circuit of a smoke detector in accordance with the present invention.

Referring now to FIG. 2, it more particularly illustrates an electrical block diagram of a second preferred embodiment of a smoke detector, generally identified 30, also constructed in accordance with the present invention. It should be noted that this smoke detector 30 incorporates all the features of a prior art smoke detector with the addition of an RF receiver 36, and the intelligence to interpret an RF message, compare the unique IDs of the transmitter (shown in FIG. 3) with the ID stored within the detector's memory and perform the "learn" function that allows the manufacturer to pair a particular transmitter to a particular smoke detector.

As shown, the smoke detector 30 includes a battery or power supply 32; a digital integrated circuit (IC) 34, which could be a micro-controller or a custom IC; an RF receiver circuit 36; an RF antenna 38, which could be a printed circuit board (PCB) trace, formed wire or even a wire pigtail; an audible alarm 42 such as a buzzer; one or more smoke sensing devices 44; and the optional "learn" switch 48.

In this second preferred embodiment of a smoke detector 30, it is to be understood that the audible alarm 42 may be "muted" or "silenced" as previously described. This is accomplished by a surge of power 52 to the RF receiver 36 that effectively "wakes up" the RF receiver circuit 36. Then, upon receipt of a signal from the remote transmitter (see FIG. 3), data 54 is sent to the digital IC 34 that a signal has been received by the RF receiver circuit 36 and a message tells the digital IC 34 to silence the alarm 42. It is also possible that the audible alarm 42 could include circuitry whereby the alarm 42 is simply reduced in its decibel level or volume, or that a light-emitting diode (LED) 50 or other light means be used to indicate the "silent" mode of operation. Such LED 50 could also be used as a remotely-operated testing light whereby a battery check may be remotely conducted by the user.

Figure 3:
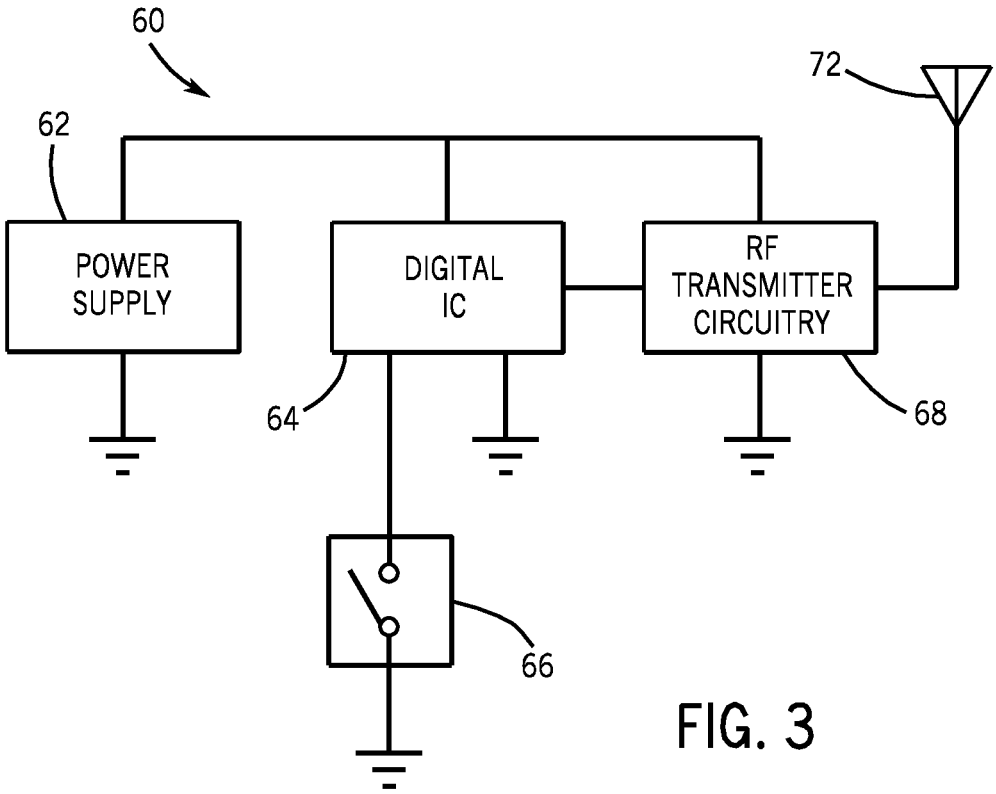
FIG. 3 is a simplified schematic diagram of an RF transmitter circuit of a smoke detector in accordance with the present invention.

Referring now to FIG. 3, it illustrates an electrical block diagram for the remote RF transmitter, generally identified 60. It includes a battery 62, which is typically a coin cell lithium type battery; a digital IC 64, which could be a micro-controller or a custom IC; a momentary push button switch 66 to trigger RF message transmission and/or battery testing of the smoke detector 30; RF transmitter circuitry 68; and an RF antenna 72, typically a trace on the PCB.

As alluded to earlier, it is preferable that the transmitter circuitry 60 also remain in an ultra-low-current or "sleep" state until the transmitter button 66 is depressed. This can also be referred to as a "no-power" or "low-power" consumption mode. Depressing the transmit button 66 forces the circuitry 60 to "wake-up" or energize by means of the battery or power supply 62 and enter a "run" mode whereby the circuitry 60 creates a digital message 64 and transmits 68 this message on an RF or other wireless carrier by means of an antenna 72. Once the transmission is complete, the transmitter 60 reverts back to the ultra-low-current state until the button 66 is depressed again. The digital modulation method utilized could be by amplitude-shift keying (ASK), by frequency-shift keying (FSK), or on-off keying (OOK) and is not a limitation of the present invention.

Figure 4:
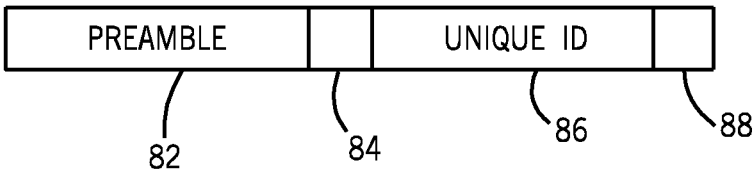
FIG. 4 is a schematic diagram of the data format of a proposed digital message in accordance with the present invention.

At a minimum, however, the transmit message must contain a preamble and a unique transmitter ID. Additionally, it could contain a cyclic redundancy check (CRC) or check-sum as well as a stop bit which indicates that the transmit message is complete. It should be noted that additional information could be added to the message while still maintaining the theme of the present invention. The transmitter 68 must be programmed with the unique transmitter ID, which would typically be three bytes in length. This unique ID could be programmed within the digital IC 64 at the time of manufacture or provisions could be incorporated into the design to program the unique ID into the device at the circuit board level. Typically, the unique ID is programmed into the digital IC by the IC manufacturer. Referring now to FIG. 4, it illustrates the data format of a proposed digital message in accordance with the foregoing. The particular message illustrated includes a preamble 82, optional stop bit or bits 84; transmitter ID 86; and optional stop bit or bites 88.

Referring again generally to the first preferred embodiment illustrated in FIG. 1, it will be shown that if, after the passage of the period of time, the conditions that activated the circuit 10 in the first place remain, then the alarm 18 will again sound, the remainder of the circuit 10 being fully activated at all times. The same functionality exists in the second preferred embodiment of the smoke detector 30. Only the alarms 18, 42 are muted or silenced by actuation of the remote transmitters 22, 60, respectively. It should be noted that the electromagnetic wavelength that the receiver components 20, 36 respond to and the wavelength that the remote transmitters 22, 60 emit should match as described earlier, although the exact wavelength of electromagnetic wave 24 or RF frequency used is not a limitation of this invention.

In the case where the detector circuit 10 of the present invention is used with a direct current battery as the power supply 14, the battery compartment is outfitted with a screw (not shown) such that the battery cannot be easily removed as an alternative to actual use of the transmitter 22.

Figure 5:
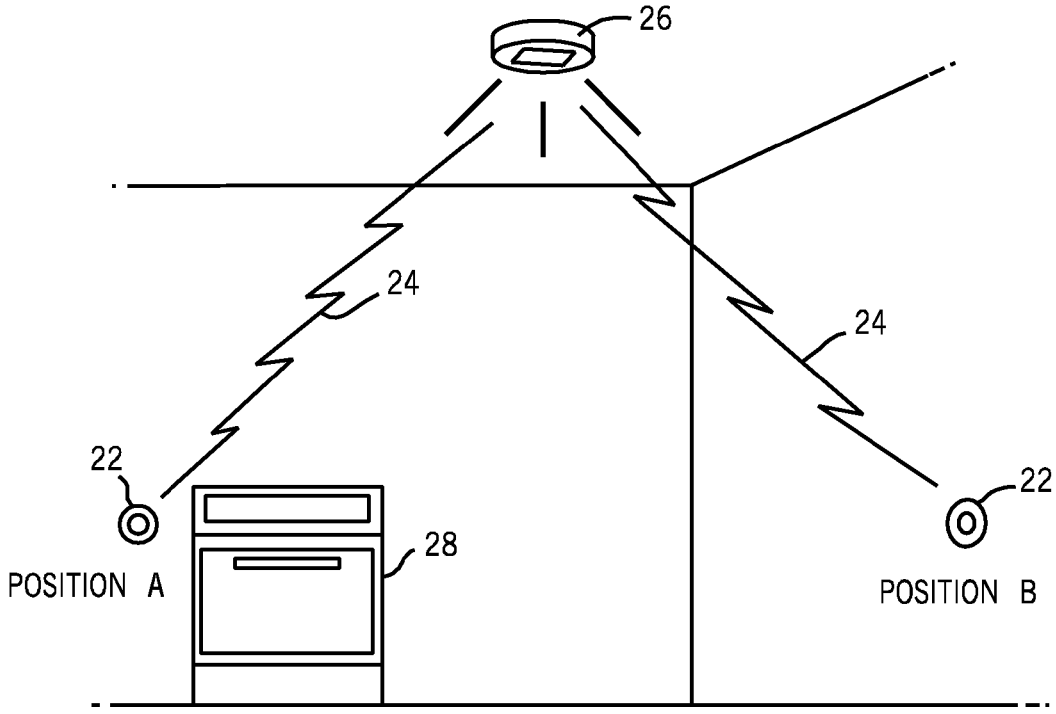
FIG. 5 is a perspective view of a smoke detector with remote alarm silencing means that is constructed in accordance with the present invention and showing the silencing means in the form of a self-contained remote unit that is locatable in a number of positions relative to the primary smoke detector itself.

As shown in FIG. 5, the smoke detector 26 of the present invention is typically secured to the ceiling of a room, for example. The transmitter 22 can be secured in multiple positions, represented by Positions A and B of FIG. 5, within the room and still be used to emit an electromagnetic wave 24 to actuate the receiver component 20 to convert it to an "open" state. In Position A, the remote transmitter 22 is secured to a wall adjacent an appliance 28. In the preferred embodiment of the present invention, the receiver component 20 includes means such that it can be pre-programmed to remain in its "open" position for a given period of time. A typical time period could be three minutes, for example. It is also contemplated by the present inventors that this period of time could be variably set by the user as such is desired or required, the precise time not being a limitation of the present invention and the smoke detector including such variable timing circuitry and sleep-mode circuitry within it as previously described. It should also be mentioned that the transmitter 22 could be manually actuated by any number of acceptable methods. A button or switch of any type could be used with equal sufficiency and without deviating from the scope of the present invention. The inventors would note, however, that the method used should be consistent with the objective of maintaining the aesthetics of the transmitter 22, such being an object of the invention. Accordingly, the button or switch used should be incorporated in such a way that it adds to the aesthetics of the transmitter 22 and doesn't detract from them.

Figure 6:
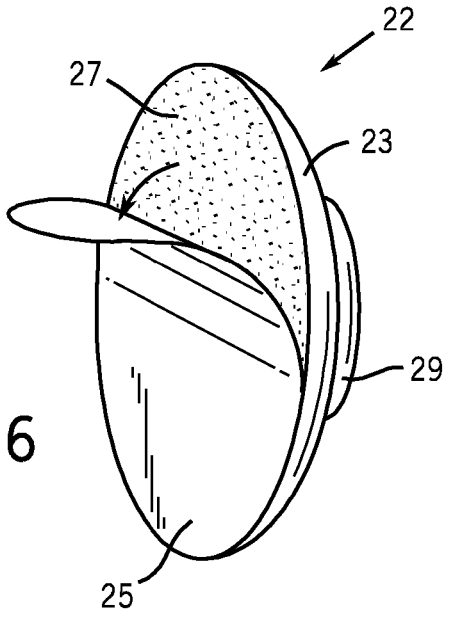
FIG. 6 is an enlarged rear perspective view of the remote control silencing unit shown in FIG. 5 and illustrating the adhesive backing of the unit.

As previously alluded to, the transmitter 22 of the present invention is movable and re-locatable throughout a multiple range of places within the room and home in which the smoke detector 26 is used. As shown in FIG. 6, the remote transmitter 22 is attachable by means of an adhesive surface 27. Prior to installation, the adhesive surface 27 is covered by a removable paper backing 25. Another very important feature of the present invention is that the remote transmitter 22 also be contained within a housing 23 having an over-sized button-switch 29 that is aesthetically-pleasing to the user and that may be purchased by the user in a personally-pleasing decorated fashion. Much in the same fashion as cellular telephone housings have become vogue in the industry with interchangeable housings that come in a wide variety of colors, patterns and designs, so too with the remote transmitter 22 of the present invention. The remote transmitter 22 could be fabricated in a wide variety of shapes, colors, patterns and designs to fit the décor of the portion of the home in which the smoke detector 26 is used. Accordingly, it is preferable to use a housing for the transmitter 22 that is fabricated in something other than the standard white or off-white plastic that the housings of smoke alarms themselves are typically molded in today. While the smoke detector 26 used in the present invention could be fabricated in those neutral colors, the transmitter 22 would not be so limited. Preferably, it would be fabricated in colors, patterns and designs to fit the décor of its surroundings. The transmitter 22 could be formed in a single encapsulated form to prevent dirt or dust from penetrating the edges of the actuating button 29. The cover or housing of the transmitter 22 could also, for example, be fabricated in a "snap-on" type format which would facilitate the quick and easy adaptability of the transmitter 22 for use throughout the home. Accordingly, the transmitter 22 could come in a variety of shapes, but should be rather small in overall dimensions. It should be small enough to be relatively innocuous, but not so small as to be easily overlooked. In the preferred embodiment, the transmitter 22 includes a housing 23 having a round or an oval-shaped housing and an over-sized button 29. The precise shape and size is not, however, a limitation of the housing 23 of the present invention. As alluded to earlier, the switch device 29 incorporated within the transmitter 22 should also contribute to the aesthetics and not detract from them. In its encapsulated form, the switch device 29 and the transmitter 22 as a whole would be impervious to environmental conditions such as dust and grease as well as moisture which would make the transmitter 22 well suited for use throughout the kitchen.

Accordingly, it will be seen that there has been provided a new, useful and non-obvious smoke detector having a remote alarm muting or silencing means in the form of a mountable remote control device wherein the remote control silencing device is not hand-held and is not hard-wired to the smoke detector and which allows the remote control silencing device to be mountable, and also relocatably so; that provides a remote control silencing device that has a self-contained long-life battery contained within it; that provides such a smoke detector that uses one or more of such remote control silencing devices to remotely silence or silence the alarm of the smoke detector for a short pre-programmed period of time, including after-market replacement of the original remote control silencing device, all of which operate on the same electromagnetic wave frequency; that has a remote control silencing device that securable to a smooth flat surface by means of an adhesive backing; and that provides a remote control silencing device that is aesthetically-pleasing to the user and that may be purchased by the user in a personally-pleasing decorated fashion and that come in a wide variety of shapes, colors, patterns and designs, or that may come with interchangeable housings having different colors, patterns and designs.

The principles of this invention having been described in accordance with the foregoing, we claim:

1. A smoke detector comprising:

a first power supply, an integrated circuit, a smoke detection component, an audible alarm, and an RF receiver, each of the foregoing being electrically connected as a circuit;

the smoke detection component being in a normally open non-conductive state and being operable to detect smoke in the ambient air, the smoke detection component being further operable to change to a closed or conductive state upon the detection of a smoke condition, wherein the smoke condition corresponds to a predetermined quantity or density of smoke particles in the ambient air;

the smoke detection component being in electric connection with the integrated circuit;

the integrated circuit being operable to activate the audible alarm when the smoke condition is detected by the smoke detection component and being operable to command the RF receiver to operate at a higher power status when the integrated circuit has activated the audible alarm;

the RF receiver in electric connection with the integrated circuit, the RF receiver being operable in a low power status to reduce battery usage; the RF receiver being operable at the higher power status upon command by the integrated circuit;

a remote transmitter comprising an RF transmitter and a second power supply for silencing false or nuisance alarms, the RF transmitter being operable to transmit a signal sent by a user using the RF transmitter to the RF receiver, the RF receiver further being operable upon receipt of the signal from the RF transmitter to transmit the signal to the integrated circuit;

the integrated circuit being operable to silence the audible alarm for a preprogrammed period of time while a remainder of the circuit remains active such that, if the smoke condition that activated the smoke detection component remains, the smoke detection component is always operable to detect the smoke particles;

the integrated circuit being operable to reactivate the audible alarm upon the expiration of the preprogrammed period of time if the smoke detection component remains in the conductive state; and wherein each of the first and second power supplies is a self-contained battery.

2. The smoke detector of claim 1 wherein the RF receiver and the RF transmitter are functionally configured to receive and transmit in accordance with a digital modulation technique.

3. The smoke detector of claim 1 further comprising an indicating light, the indicating light being lit when the audible alarm is remotely silenced.

4. The smoke detector of claim 3 wherein the remote transmitter further comprises means for using the indicating light to remotely test the charge of the first power supply.

5. The smoke detector of claim 1 wherein the remote transmitter further comprises means for reducing the audible volume of the audible alarm.

* * * * *